US006450569B1

(12) United States Patent
Liu

(10) Patent No.: US 6,450,569 B1
(45) Date of Patent: Sep. 17, 2002

(54) FOLDING STRUCTURE FOR FOLDING CHAIRS

(76) Inventor: Lausan Chung-Hsin Liu, No. 243, Chien-Kuo Road, Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/948,542

(22) Filed: Sep. 10, 2001

(51) Int. Cl.[7] ..... A47C 4/44
(52) U.S. Cl. ..... 297/39; 297/35
(58) Field of Search ..... 297/16.1, 35, 39, 297/46

(56) References Cited

U.S. PATENT DOCUMENTS 2,957,516 A * 10/1960 Kubisz ..... 297/39
4,536,026 A * 8/1985 Cornell ..... 297/39
4,772,068 A * 9/1988 Gleckler et al. ..... 248/188.5
5,054,848 A * 10/1991 Liu ..... 297/16.1
5,735,570 A * 4/1998 Tseng ..... 297/35
6,095,596 A * 8/2000 Chen ..... 297/35

* cited by examiner

*Primary Examiner*—Peter R. Brown
(74) *Attorney, Agent, or Firm*—Bacon & Thomas, PLLC

(57) ABSTRACT

An improved folding structure for a folding chair. The structure includes a seat bracket, a backrest bracket pivotally engaged with a rear end of the seat bracket, two armrests pivotally engaged with two sides of the backrest bracket, and front and rear legs located at two sides of the seat bracket and pivotally engaged with the armrests. The backrest bracket and the rear legs are pivotally engaged through a pivotal lever in a toggle joint manner at a pivotal fulcrum. The backrest bracket is coupled with a cradle hub which has a flange extended towards the rear leg. The backrest bracket is allowed to swing about the pivotal fulcrum relative to the rear leg for extending or folding the folding chair with the flange resting on the rear leg to reduce the size of the folding chair when folded.

4 Claims, 8 Drawing Sheets

FOLDING STRUCTURE FOR FOLDING CHAIRS

FIELD OF THE INVENTION

The present invention relates to an improved folding structure for folding chairs and particularly a folding structure for reducing the size of folding chairs.

BACKGROUND OF THE INVENTION

A conventional folding chair such as the one shown in FIGS. 1, 2 and 3 generally includes a seat bracket, a backrest bracket pivotally engaging with the rear end of the seat bracket, and front legs and rear legs located at two sides of the seat bracket, and two armrests pivotally mounted to the top ends of the front and rear legs. For folding the chair, first, move a safety latch mounted on the rear leg upwards to disengage the safety latch from a pivotal lever, then apply force on the backrest bracket and seat bracket to move the two folding towards each other. The front legs will be moved about the pivotal joints where the seat bracket and armrest engaged and move towards the rear legs. The backrest bracket having formed a toggle joint relationship with the seat bracket through the pivotal lever which has one end engaged with a shaft pivotally fastened to one side of the rear leg, will be swung relative to the rear leg and moved towards the rear leg. The seat bracket will be driven by the backrest bracket and move toward the backrest bracket such that both the seat bracket and backrest bracket will be juxtaposed between the front and rear legs. The folding chair thus may be folded and reduced to a smaller size to facilitate transportation and storing. However, the folding mechanism set forth above still have drawbacks, notably:

1. In order to make the seat bracket and backrest bracket moving and folding simultaneously, the seat bracket has to extend an extra rear section to engage with the pivotal lever. The extra rear section of the seat bracket cannot seat people when the chair is extended. It becomes a waste and increases costs without adding benefits.
2. The pivotal lever is an integrated two-piece element with a shaft running through the rear leg. The interval of the two-piece element forms a swing space for the backrest bracket. The two-piece element further has an integral head attached to the rear leg for latching the safety latch. After the chair is folded, the head of the pivotal lever is extended outwards and often result in piercing through the package cartons or scratch the surrounding goods. To prevent this from happening, the package cartons have to be made larger. This increases the shipping size and transportation costs. It also takes more storage space. The jutting head of the pivotal lever also tends to injure people, particularly children, when extended for use. It is not a safe design and still has rooms for improvement.

SUMMARY OF THE INVENTION

The primary object of the invention is to resolve the foregoing disadvantages. The invention provides an improved folding structure that has a smoother profile when folded and does not have jutting object, thus can greatly reduce the folding size. The folding structure of the invention includes a pivotal lever to link the backrest bracket and the rear legs. The backrest bracket has a cradle hub with a flange extending towards the rear leg. The pivotal lever has one end attached to a shaft pivotally engaging with the rear leg. The shaft may function as a fulcrum when the chair is folding to allow the backrest bracket and rear legs to extend or fold pivotally. The flange may rest on the rear leg at different spots when the chair is extended for use or folded. Hence the folding chair may be shrunk to a much smaller size.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
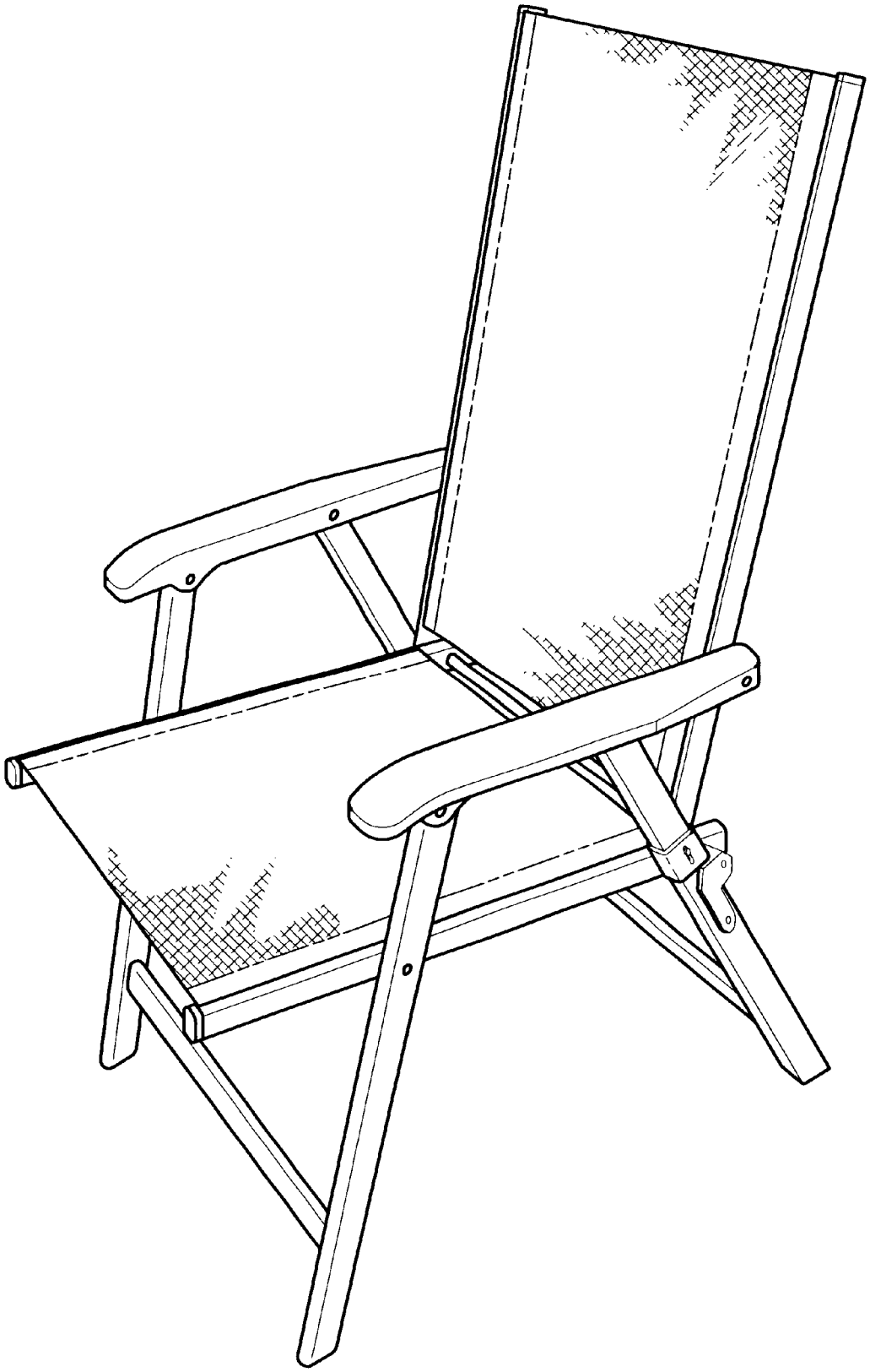
Fig.1 PRIOR ART
FIG. 1 is a perspective view of a conventional folding chair.
Figure 2:
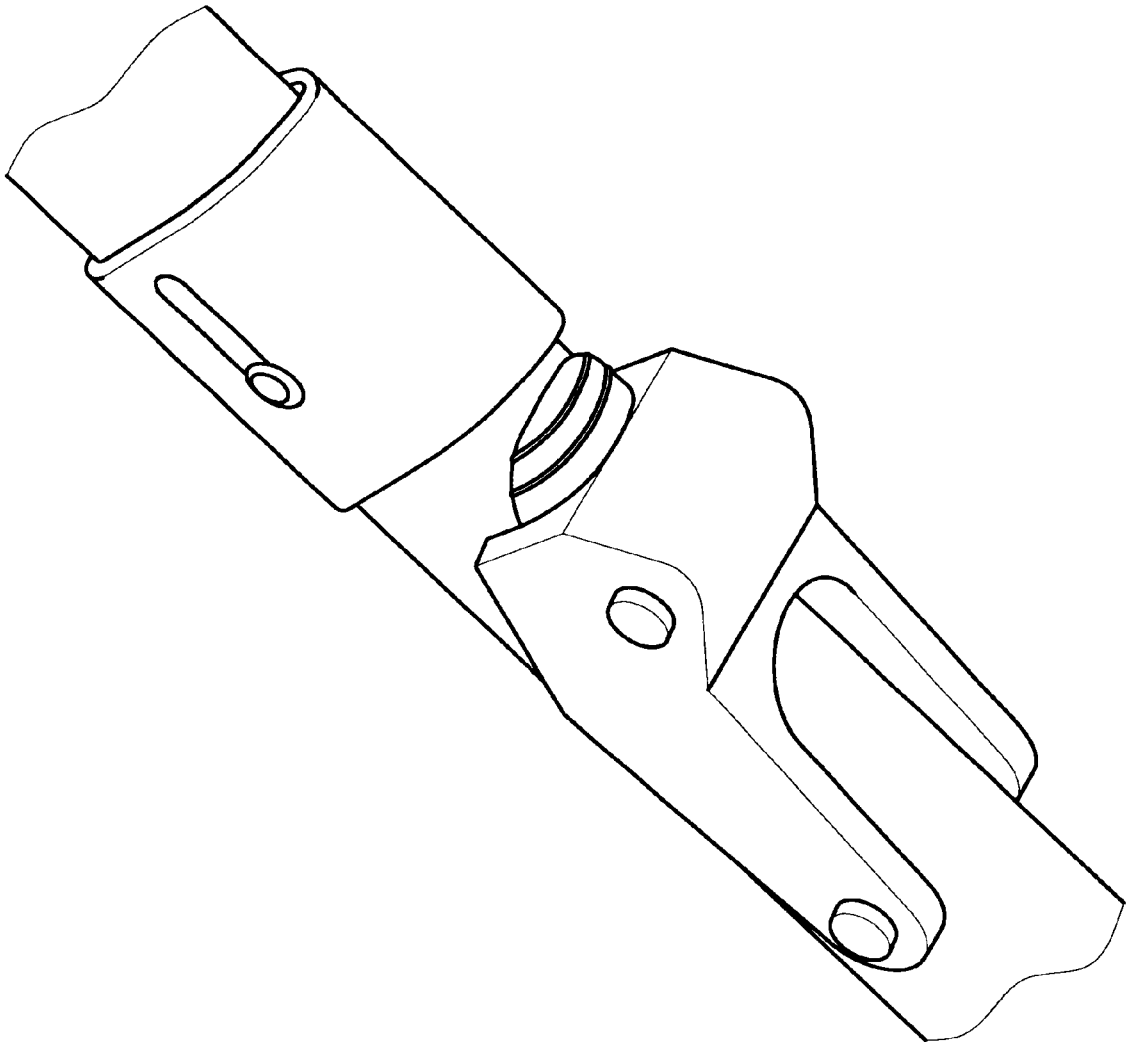
Fig.2 PRIOR ART
FIG. 2 is a fragmentary schematic view of a safety latch of a conventional folding chair.
Figure 3:
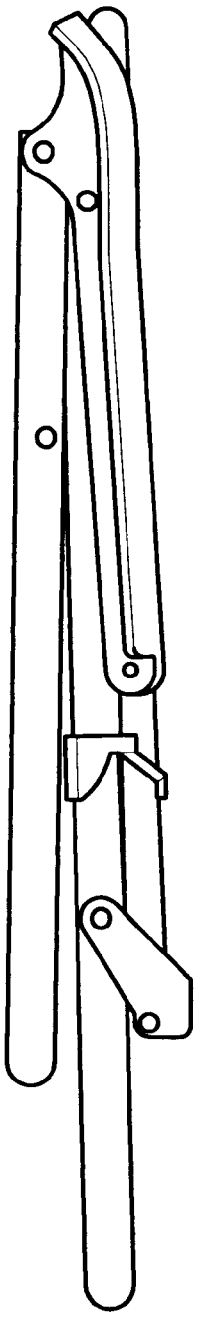
Fig.3 PRIOR ART
FIG. 3 is a schematic view of a conventional chair, folded.
Figure 4A:
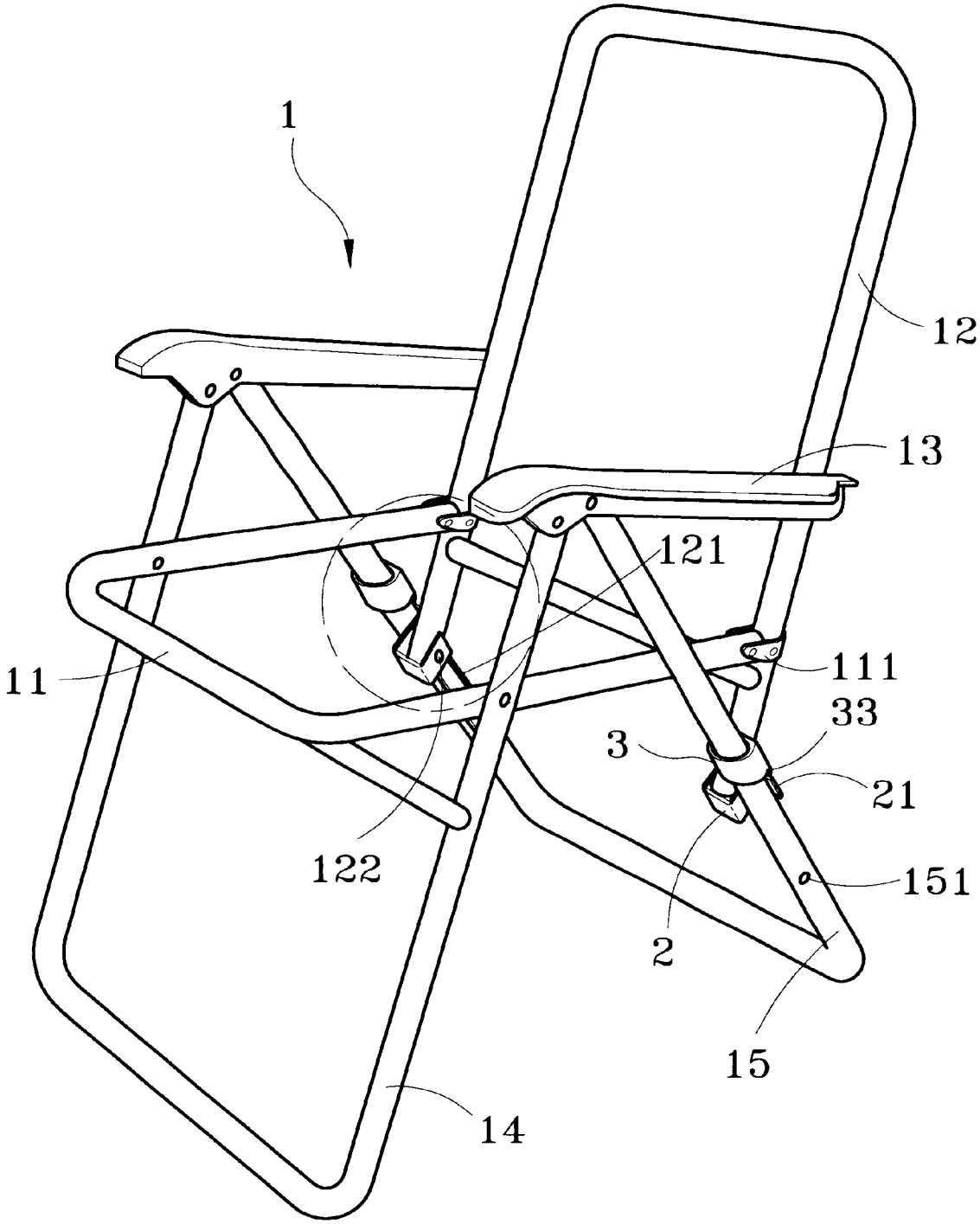
FIG. 4A is a perspective view of the invention.
Figure 4B:
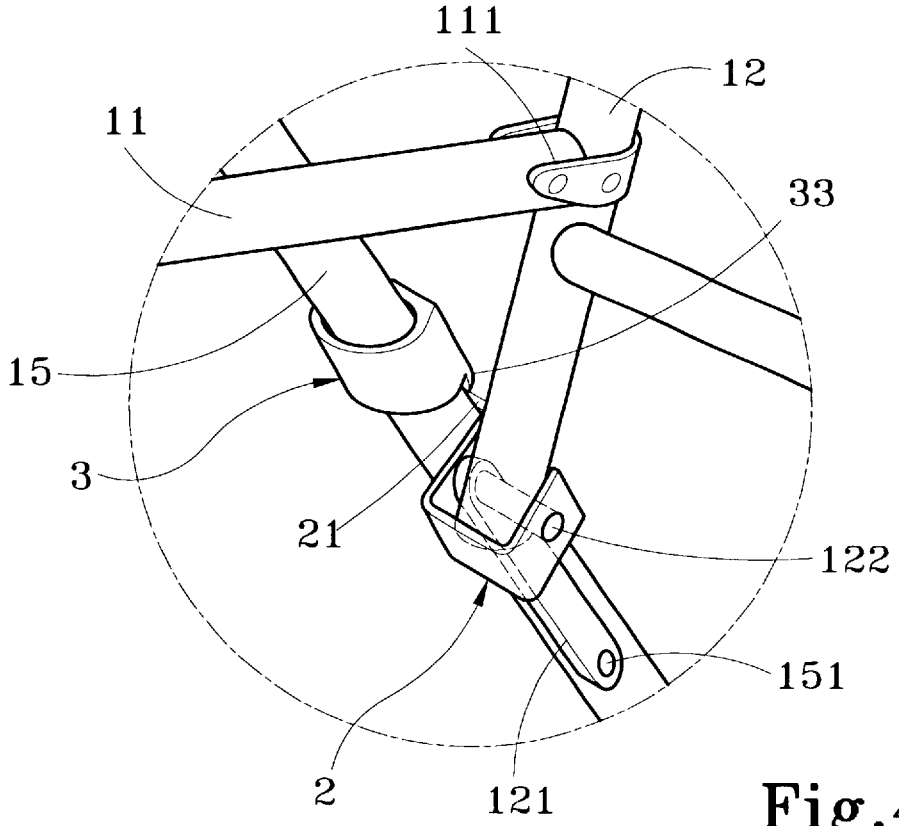
FIG. 4B is a fragmentary enlarged view of the invention.
Figure 5:
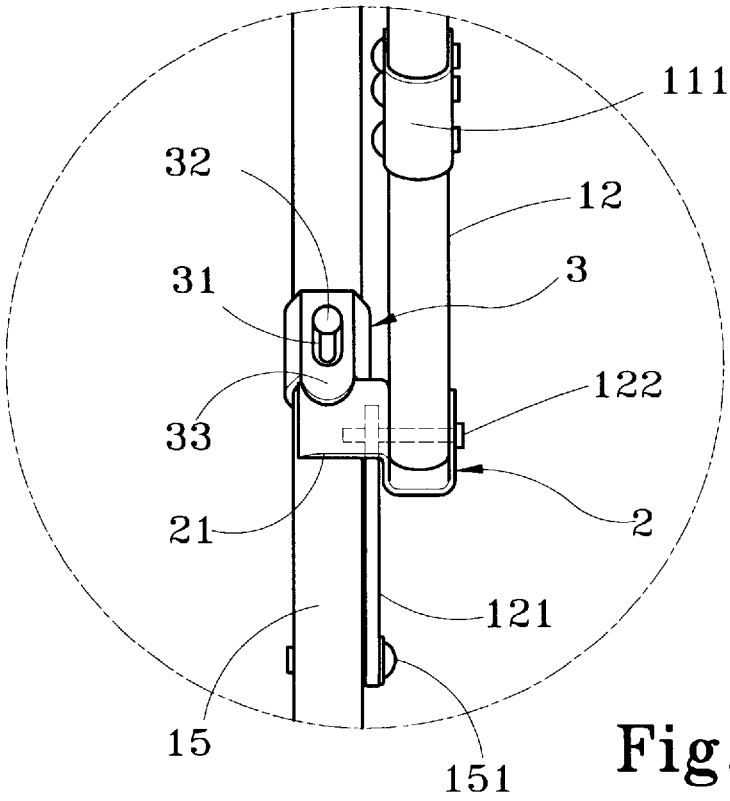
FIG. 5 is a fragmentary rear view of the invention.

Referring to FIGS. 4A, 4B and 5, the folding chair 1 of the invention consists of a seat bracket 11, a backrest bracket 12 pivotally engaged with the rear end of the seat bracket 11, two armrests 13 pivotally engaged with two sides of the backrest bracket 12, and front and rear legs 14, 15 located at two sides of the seat bracket 11 and pivotally engaged with the armrests 13. The seat bracket 11 is pivotally engaged with the backrest bracket 12 through a pivotal clip 111. The backrest bracket 12 further engages with the rear leg 15 in a toggle joint manner through a pivotal lever 121. There is a cradle hub 2 mounted to the backrest bracket 12. The cradle hub 2 has a curved flange 21 extending sidewards to match and rest on the rear leg 15. The pivotal lever 121 is a blade and has one end attached to a first shaft 122 running through the cradle hub 2 and backrest bracket 12, and another end attached to a second shaft 151 running-through the rear leg 15. The rear leg 15 has a safety latch 3 mounted at a location mating the flange 21. The safety latch 3 has a slot 31, an anchor bolt 32 located in the slot 31 and a latch tongue 33 extended to latch the flange 21. The folding chair I thus may be extended or folded by swinging the backrest bracket 12 relative to the rear leg 15 apart or toward each other about the fulcrums at the second shaft 151, and allows the flange 21 resting on the rear leg 15 when the folding chair I is extended for use or folded. The folding chair I thus may be reduced to a smaller size.

Figure 6A:
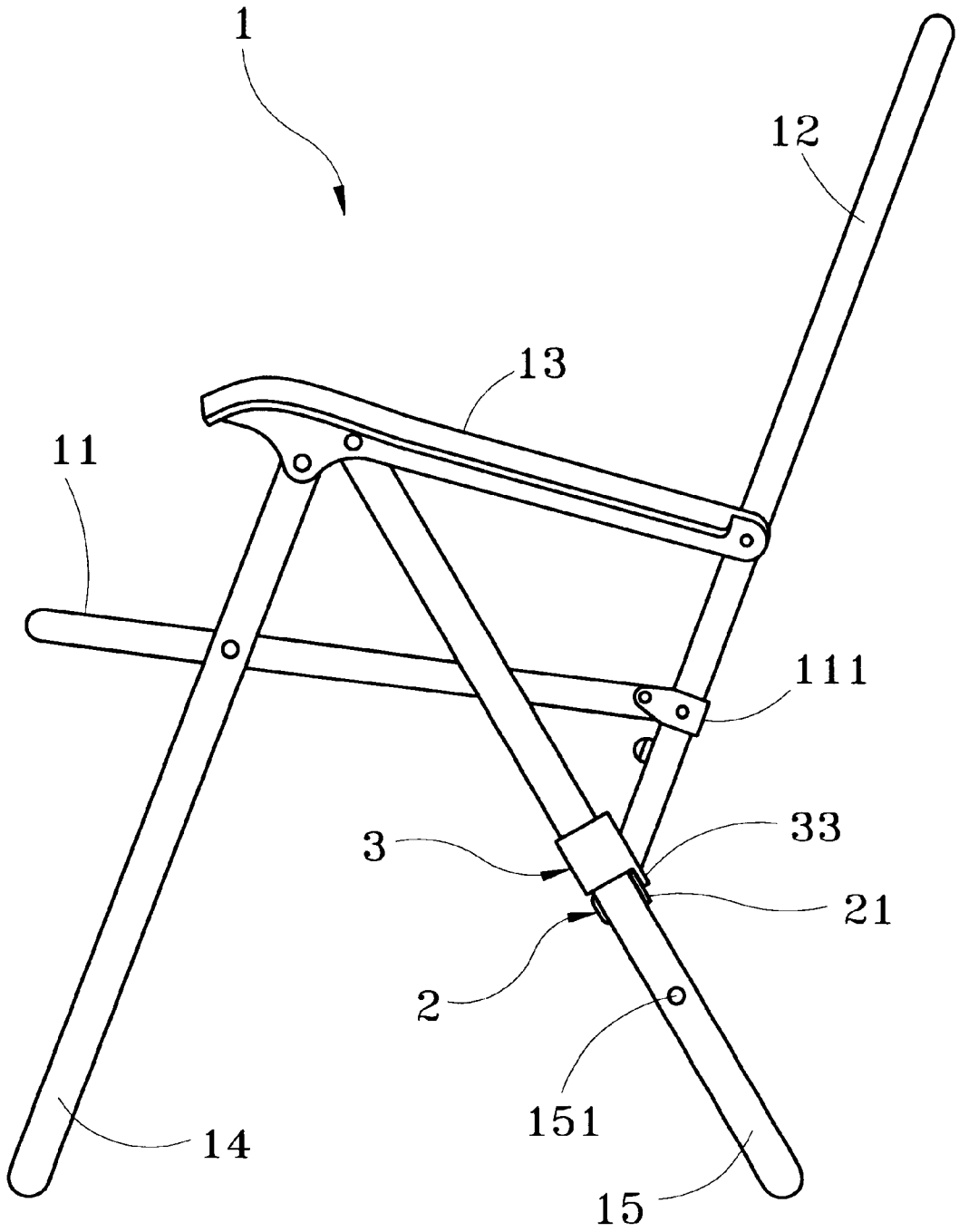
FIGS. 6A, 6B and 6C are schematic views of the invention, at various folding stages.
Figure 6B:
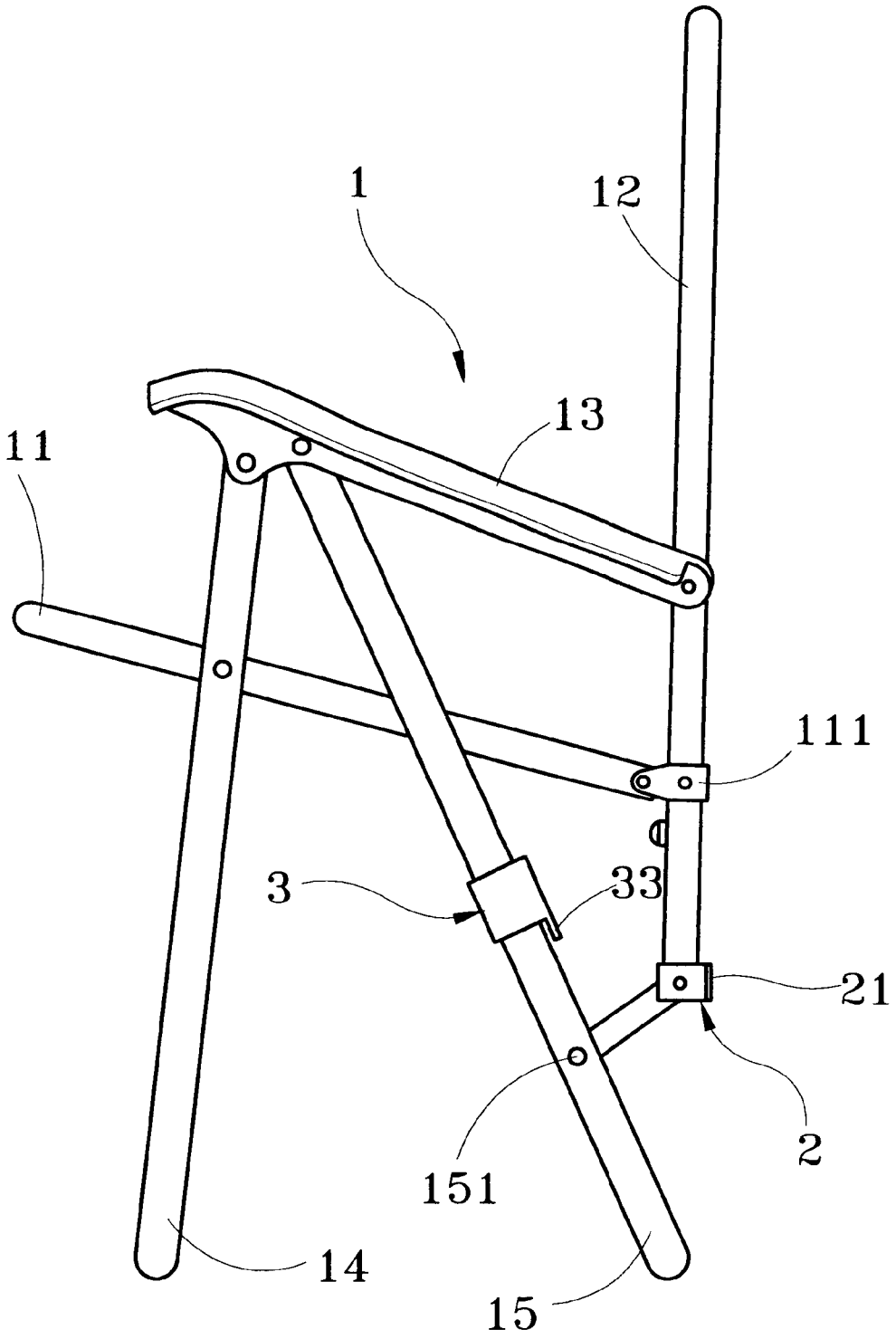
Figure 6C:
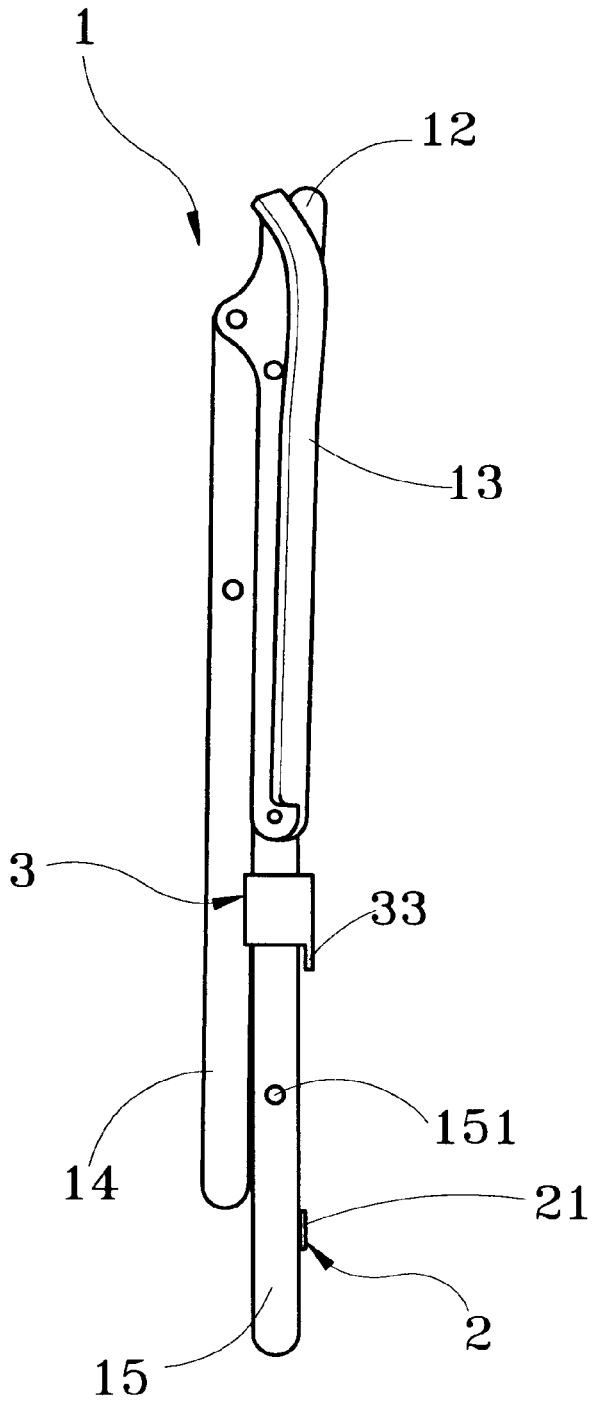

Referring to FIGS. 6A and 6B, when to fold the folding chair 1, move the safety latch 3 upwards through the guiding of the slot 31 and anchor bolt 32 to disengage the latch tongue 33 from the flange 21, then apply force on the armrests 13 or seat bracket 11 to move towards the backrest bracket 12. The seat bracket 1 1 will drive the front leg 14 through the pivotal point therebetween toward the rear leg 15, the backrest bracket 12 and seat bracket 11 move toward each other through the pivotal clip I 1 1, the second shaft 151 jointly engaged by the pivotal lever 121 and rear leg 15 will function as a fulcrum to allow the backrest 12 and cradle hub 2 swinging relative to the rear leg 15. When the backrest bracket 12 and the seat bracket 11 are completely juxtaposed and held between the front legs 14 and rear legs 15, the flange 21 of the cradle hub 2 will be rested on the rear leg 15 at another spot as shown in FIG. 6C. Thus the folding chair 1 may be folded in a compact size and form a smooth profile from the armrests 13 to the rear legs 15. Such a construction not only can reduce size, but also can prevent incidental injury to people that might otherwise happen.

While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An improved folding structure for a folding chair comprising:

a seat bracket, a backrest bracket pivotally engaged with a rear end of the seat bracket, two armrests pivotally engaged with two sides of the backrest bracket, and front and rear legs located at two sides of the seat bracket and pivotally engaged with the armrests;

wherein the backrest bracket and the rear leg are pivotally engaged with each other in a toggle joint through a pivotal lever and a shaft which serves as a fulcrum, the backrest bracket is coupled with a cradle hub which has a flange extended towards the rear leg, the backrest bracket is allowed to swing about the fulcrum relative to the rear leg for extending or folding the folding chair with the flange resting on the rear leg to reduce the size of the folding chair when folded; and wherein the rear leg has a safety latch mated to the flange, the safety latch having a slot, an anchor bolt located in the slot and a latch tongue latches the flange.

2. The improved folding structure for a folding chair of claim 1, wherein the flange is formed in a curved shape to match the rear leg.

3. The improved folding structure for a folding chair of claim 1, wherein the seat bracket and backrest bracket are engaged through a pivotal clip.

4. The improved folding structure for a folding chair of claim 1, wherein the pivotal lever is formed in a blade, and is engaged with the cradle hub and the backrest bracket through another shaft, and has another end engaged with the rear leg through said another shaft.

* * * * *